United States Patent [19]

Martin

[11] 4,195,979

[45] Apr. 1, 1980

[54] LIQUEFACTION OF HIGH PRESSURE GAS

[75] Inventor: Michael D. Martin, Bartlesville, Okla.

[73] Assignee: Phillips Petroleum Company, Bartlesville, Okla.

[21] Appl. No.: 905,507

[22] Filed: May 12, 1978

[51] Int. Cl.[2] ..... F25J 3/02

[52] U.S. Cl. ..... 62/26; 62/27; 62/40

[58] Field of Search ..... 62/40, 9, 11, 23, 26, 62/27, 28, 24, 38

[56] References Cited

U.S. PATENT DOCUMENTS

| | | | |
|---|---|---|---|
| 2,582,148 | 1/1952 | Nelly, Jr. | 62/23 |
| 2,600,110 | 6/1952 | Hachmuth | 62/40 |
| 2,960,837 | 11/1960 | Swenson et al. | 62/40 |
| 3,020,723 | 2/1962 | De Lury et al. | 62/40 |
| 3,342,037 | 9/1967 | Kniel | 62/26 |
| 3,389,565 | 6/1968 | Ergenc | 62/38 |
| 3,613,387 | 10/1971 | Collins | 62/38 |

*Primary Examiner*—Norman Yudkoff

[57] ABSTRACT

A process for liquefying a gas at a pipeline pressure of above about 650 psia and at ambient temperature, in which the gas is cooled to sequentially lower temperatures, by passing the gas through a plurality of cooling stages in indirect heat exchange with at least one refrigerant and near its liquefaction temperature, the cooled gas is expanded to a lower pressure, the expanded gas is further cooled to its liquefaction temperature, using indirect heat exchange with an expanded refrigerant, the liquefied gas is expanded to atmospheric pressure for storage or transport, by passing the liquefied gas through at least one expansion stage and vapors collected from the expanded stage are compressed and added to the expanded gas prior to liquefaction. To the extent that the gas is natural gas and contains significant amounts of nitrogen, the liquefied gas is passed through a nitrogen rejection cycle prior to passage through the expansion stage.

21 Claims, 1 Drawing Figure

LIQUEFACTION OF HIGH PRESSURE GAS

BACKGROUND OF THE INVENTION

The present invention relates to the liquefaction of a gas. More particularly, the present invention relates to a method for the liquefaction of a lean natural gas having a pressure above about 650 psia and at essentially atmospheric temperature.

Numerous reasons exist for the liquefaction of gases and particularly of natural gas. The primary reason for the liquefaction of natural gas is that the liquefaction reduces the volume of a gas by a factor of about 1/600, thereby making it possible to store and transport the liquefied gas in containers of more economical and practical design.

For example, when gas is transported by pipeline from the source of supply to a distant market, it is desirable to operate under a substantially constant high load factor. Often the capacity will exceed demand while at other times the demand may exceed the capacity of the line. In order to shave off the peaks where demand would exceed supply, it is desirable to store the gas when the supply exceeds demand, whereby peaks in demand can be met from material in storage. For this purpose it is desirable to provide for the storage of gas in a liquefied state and to vaporize the liquid as demand requires.

Liquefaction of natural gas is of even greater importance in making possible the transport of gas from a source of plentiful supply to a distant market, particularly when the source of supply cannot be directly joined with the market by pipeline. This is particularly true where transport must be made by ocean going craft. Ship transportation in the gaseous state would be uneconomical unless the gaseous materials were highly compressed, and then the system would not be economical because it would be impractical to provide containers of suitable strength and capacity.

In order to store and transport natural gas, the reduction of the natural gas to a liquefied state requires cooling to a temperature of about −240° F. to −260° F. at atmospheric pressure.

Numerous systems exist in the prior art for the liquefaction of natural gas or the like in which the gas is liquefied by passing it sequentially through a plurality of cooling stages, to cool the gas to successively lower temperatures until the liquefication temperature is reached. In this instance, cooling is generally accomplished by indirect heat exchange with one or more refrigerants such as propane, propylene, ethane, ethylene, and methane. Once the gas has been liquefied at the feed gas pressure, the gas is expanded to atmospheric pressure by passing the liquefied gas sequentially through a plurality of expansion stages. During the course of the expansion, the gas is further cooled to storage or transport temperature and its pressure reduced to atmospheric pressure, and significant volumes of the gas are flashed. The flashed gas from the expansion stages is generally collected, compressed to the pressure of the feed gas and then combined with the feed gas.

The optimum operating pressure for such systems is generally about 600 psia. However, it has become increasingly common to transport natural gas through large volume pipeline systems which operate at high pressures in order to reduce the size of the pipe required to transport the gas. It is therefore necessary, in many cases, to liquefy gas at these high pipeline pressures, which are generally significantly above 600 psia, for example, above about 865 psia. The liquefaction of such natural gases at these high pressures creates numerous problems in the liquefaction process. The most significant problem is the power requirements of the liquefaction system. When the system is operated at high pressures, the power requirements for compressing the flashed vapors for recycle significantly increase as the pressure of the feed gas increases.

It is therefore an object of the present invention to overcome the above and other problems of the prior art. It is another object of the present invention to provide an improved system for liquefying high pressure gases. Still another object of the present invention is to provide an improved method for liquefying gases at high pressures, wherein the power requirements of the liquefaction system are substantially reduced.

SUMMARY OF THE INVENTION

The above and other objects of the present invention are accomplished by cooling a gas, having an elevated pressure above about 650 psia, reducing the pressure of the gas and, thereafter, further cooling the gas at the reduced pressure to a temperature at which the gas is liquefied.

To the extent that the gas is a natural gas containing significant amounts of nitrogen, the nitrogen is removed by passing liquefied gas through a nitrogen rejection cycle.

BRIEF DESCRIPTION OF THE DRAWINGS

The single FIGURE of drawings shows a simplified flow diagram of the process of the present invention.

DETAILED DESCRIPTION OF THE PREFERRED EMBODIMENTS

Figure 1:
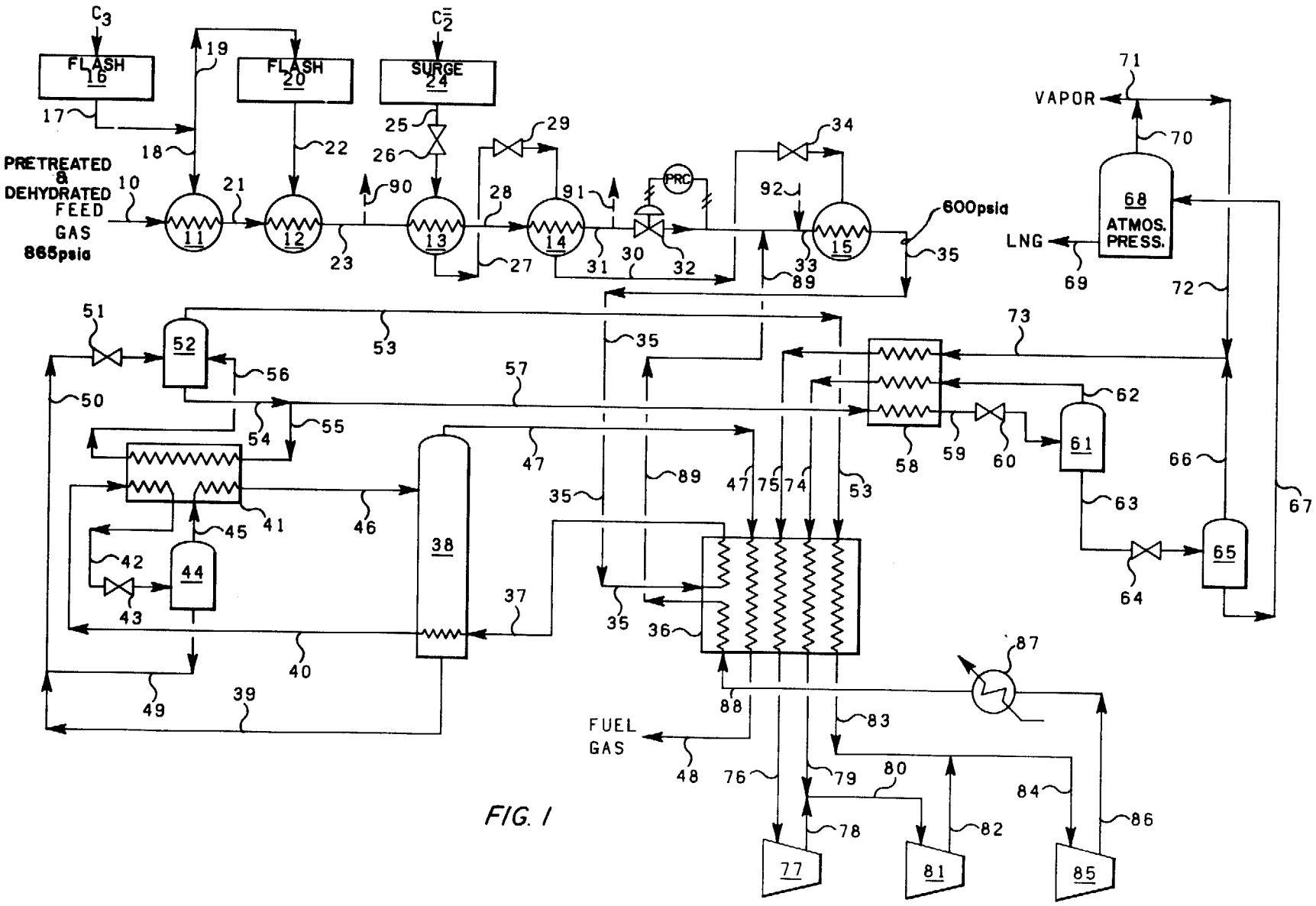

The detailed description of the present invention will be made with reference to the liquefaction of a lean natural gas and specific reference will be made to the liquefaction of a lean natural gas having an initial pressure of about 865 psia at ambient temperature. It is to be understood that the detailed description and the reference to a specific gas and specific temperatures, pressures and equipment is by way of illustration only and is not to be considered in any way limiting, since the process can be applied with equal facility to the liquefaction of any gas at relatively high pressure. p It is also to be understood that, where reference is made to a lean natural gas, this term refers to a gas that is predominantly methane, for example, 85% by volume of methane with the balance ethane and higher hydrocarbons and nitrogen. Where reference is made to a rich natural gas, this term is used to refer to a gas generally associated with a liquid petroleum containing lesser amounts of methane and predominant amounts of higher hydrocarbons such as ethane, propane, butanes, and pentanes.

Referring now to the drawing, the feed gas is introduced to the system through line 10. The particular feed gas, referred to by way of example, is at a pressure of about 865 psia at atmospheric temperature. In addition, the subject feed gas has been pretreated to remove moisture, acid gases, such as carbon dioxide, hydrogen sulfide and the like by desiccation, amine extraction and the like. In the specific gas referred to, residual amounts of nitrogen are assumed to exist, which should be removed prior to the storage and transport of the liquefied gas.

The feed gas from line 10 is passed through a plurality of heat exchangers or chillers 11, 12, 13, 14 and 15, respectively. The passage of the feed gas through heat exchangers 11 through 15 is sequential. In passing through the chillers, the feed gas is cooled to successively lower temperatures by indirect heat exchange with expanded refrigerants. Specifically, stages 11 and 12 are cooled by expanding propane supplied from a compressor means (not shown). The propane is expanded in high stage flash drum 16 and the unflashed liquid is passed through line 17. A portion of the propane from line 17 passes through line 18 to heat exchanger 11. In being flashed in flash drum 16, the pressure of the propane is reduced to about 34.7 psia. Another portion of the propane passes through line 19 to interstage flash drum 20. As the feed gas passes through chiller 11 its temperature is reduced to about −1° F., and it is then passed to chiller 12 through line 21. Unflashed liquid propane from interstage flash drum 20 is passed through line 22 to chiller 12. The flashed propane gases from heat exchangers 11 and 12 are withdrawn and returned to the compressor means for further use. When flashed in flash drum 20 the pressure of the propane is reduced to about 19.4 psia. The feed gas, in passing through chiller 12, has its temperature lowered to about −28° F. and is then passed through line 23 to chiller 13. Further cooling of the gases, in chillers 13, 14 and 15, is accomplished by expanding liquid ethylene supplied from ethylene surge tank 24. Ethylene is supplied from surge tank 24 through line 25 and expansion means 26 to chiller 13. In passing through expansion means 26, the pressure of the ethylene is reduced to about 120.1 psia. Liquid ethylene from chiller 13 is discharged through line 27. Chiller 13 is a high stage ethylene feed gas chiller. The feed gas, in passing through chiller 13 has its temperature reduced to about −67° F. and is then passed to interstage ethylene feed gas chiller 14 through line 28. Liquid ethylene from line 27 passes through expansion means 29 to chiller 14. Liquid ethylene is discharged from chiller 14 through line 30. The feed gas discharged from interstage ethylene feed gas chiller 14 is at a temperature of about −106° F. and essentially the original pressure of about 865 psia. At this temperature and pressure, the feed gas is not yet liquefied but is near its liquefaction temperature. From line 31 the feed gas passes through expansion valve 32 and its pressure is reduced to a pressure below the original pressure and specifically about 600 psia. The reduced pressure gas is passed from the expansion valve 32 through line 33 to chiller or feed condenser 15. Liquid ethylene from line 30 is passed through expansion means 34 to chiller 15. Flashed ethylene gas from chillers 13, 14 and 15 is returned to an ethylene compressor means (not shown). As will be pointed out more specifically hereinafter, by expanding the feed gas and reducing its pressure at this point, rather than prior to introduction of the gas to the liquefaction system, significant reductions in the power required by the plant are attained.

While the propane and ethylene compression and liquefaction cycles are not shown, these cycles will normally be integrated in cascade fashion (compressed ethylene is liquefied by cooling it with a portion of the propane refrigerant). Systems for accomplishing this are well known to those skilled in the art. In addition, the compressors may be multistage compressors or a series of single stage compressors as is also known to those skilled in the art.

In passing through feed condenser 15, the gas has its temperature reduced to about −134° F. and it is discharged through line 35. At this point, the temperature is below the liquefaction temperature of the gas at the lowered pressure of about 600 psia.

The liquefied natural gas passing through line 35 can be expanded at this stage to reduce the pressure to atmospheric pressure for storage or transport. However, normally the gas will contain significant residual amounts of nitrogen which should be removed. Consequently, liquefied natural gas from line 35 is passed through heat exchanger or methane economizer 36. In passing through methane economizer 36, the temperature of the liquefied natural gas is further reduced to about −141° F. From heat exchanger 36, the liquefied gas passes through line 37 and thence through the reboiler of nitrogen fractionation tower 38. Liquid bottoms product is discharged from column 38 through line 39. Liquefied gas passed through the reboiler of column 38 is passed through line 40 at a temperature of about −144° F. From line 40 the liquefied gas is passed through fuel flash condenser 41, thence through line 42 and expansion valve 43 to fuel flash drum 44. The separated vapors from flash drum 44 are passed through line 45, condenser 41 and line 46 to the top of column 38. The liquid from line 46 serves as a reflux for column 38, partially condensing the rising vapors in column 38 and thus condensing part of the hydrocarbons therefrom while the rising vapors in column 38 strip nitrogen from the liquid introduced through line 46. Overhead vapors from column 38, containing substantially all of the residual nitrogen and predominant amounts of methane, are discharged through line 47. From line 47 the vapors pass through heat exchanger 36 in countercurrent, indirect heat exchange with the liquefied natural gas. From heat exchanger 36 the vapors from column 38 are discharged through line 48. This gas normally will have sufficient methane content to be suitable for use as a plant fuel gas. Consequently, it may be utilized in the system itself or for other in-plant use. Liquefied natural gas, separated as a bottoms product in flash drum 44 is passed through line 49. The liquefied natural gas in line 49 is at a temperature of about −159° F. The liquefied gas from lines 39 and 49 is combined in line 50 and then passes sequentially through a plurality of expansion stages until the pressure thereof is reduced to approximately atmospheric pressure for storage or transport. Specifically, liquefied natural gas is passed through expansion valve 51 to flash drum 52. Flashed vapors from flash drum 52 are discharged through line 53 while the unflashed liquefied gas is discharged through line 54. In passing through expansion valve 51, the pressure of the liquefied natural gas is reduced to about 179 psia and the temperature of the liquefied natural gas in line 54 is about −185° F. A portion of the liquefied gas in line 54 is passed through line 55, thence in indirect countercurrent heat exchange with the liquid from line 40 and the vapor from line 45 in exchanger 41, and is returned to flash drum 52 through line 56. The remainder of the liquefied gas from line 54 passes through line 57 to interstage methane economizer 58. From economizer 58 the liquefied gas passes through line 59 and expansion valve 60 to interstage flash drum 61. In flash drum 61, flashed vapors are separated and discharged through line 62, while unflashed liquefied natural gas passes through line 63. In passing through expansion valve 60, the pressure of the liquefied natural gas is reduced to about 59 psia and its temperature is reduced to about −224° F. Liquefied natural gas from line 63 passes through expansion valve 64 to final flash drum 65. Vapors separated in flash drum 65 are discharged through line 66 while the unflashed liquefied natural gas is discharged through line 67. In passing through expansion valve 64, the pressure is reduced to about 25.5 psia and the temperature is reduced to about −246° F. The liquefied natural gas from line 67 is then pumped to liquefied natural gas storage tank 68. Liquefied natural gas from storage tank 68 may be withdrawn through line 69 for transport or use. In storage unit 68, the liquefied natural gas will normally expand slightly thereby reducing the pressure to near ambient pressure and reducing the temperature to about −258° F. Vapors from storage unit 68 are discharged through line 70. Vapors from line 70 may be passed to a gas storage unit through line 71. Alternatively, all or a part of the vapors from line 70 may be passed through line 72 and combined with the vapors in line 66 and passed through line 73. The combined vapors in line 73 and the vapor in line 62 are passed in countercurrent, indirect heat exchange with the liquefied natural gas in heat exchanger 58. From heat exchanger 58, the gases from lines 62 and 73 are passed through lines 74 and 75, respectively, to heat exchanger 36, In heat exchanger 36 the gases in lines 74 and 75, and also that passing through line 53, pass in countercurrent, indirect heat exchange with the liquefied natural gas from line 35. Vapors passing through heat exchanger 36 from line 75 pass through line 76 to compressor 77. This gas is compressed in compressor 77, and discharged through line 78. The gas passing through line 74 and heat exchanger 36 is discharged through line 79 and is combined with the compressed gas from line 78 to line 80. From line 80 the combined gas is passed to compressor 81. Compressed gas from compressor 81 is discharged through line 82. Gas from line 53, passing through heat exchanger 36, then passes through line 83 and is combined with the gas from line 82 in line 84. The gas in line 84 is fed to compressor 85, where it is compressed and discharged through line 86 and is precooled by propane in cooler 87. The vapors collected from flash drums 52, 61 and 65 and from the vapor space of storage unit 68 are discharged from the compressor cycle at a pressure essentially equal to the reduced pressure of the natural gas in line 33 or about 600 psia. It is clear, as will be illustrated hereinafter, that by recycling the recovered methane vapors to the liquefaction system, after the pressure of the feed gas has been reduced by expansion valve 32, significant reductions in the power required to compress the recycled gas are attained. The compressed and further cooled methane from line 88 is passed in countercurrent, indirect heat exchange with the recovered vapors in heat exchanger 36 and is then passed through line 89. In passing through heat exchanger 36 the temperature of the compressed gas is further reduced to about −106° F. The gas from line 89 is then combined with the gas in line 33 and passed through feed condenser 15 along with the feed gas.

If the feed gas is a rich natural gas containing significant amounts of ethane and higher molecular weight hydrocarbons, such higher molecular weight hydrocarbons will condense as the gas is cooled and accordingly these condensed liquids should be removed prior to the liquefaction of the gas stream by feed condenser 15. These condensed heavy hydrocarbon liquids can be withdrawn from the cooling cycle at appropriate points, such as in appropriate separators (not shown) connected to lines 90 and 91. These condensed higher molecular weight hydrocarbons will contain significant amounts of methane in solution. Consequently, liquids withdrawn from lines 90 and 91 would normally be passed to a demethanizer column (not shown) where a natural gas liquids stream would be withdrawn as a bottoms product and a substantially pure methane stream would be withdrawn as an overhead or vapor product. The overhead vapor phase methane from the demethanizer can then be recycled to the liquefaction system, as by introduction through line 92. The methane passing through line 92 would be combined with the feed gas passing through line 33 to feed condenser 15 and, accordingly, may require compression and/or cooling prior to addition to the feed gas.

For convenient reference, the pressures and temperatures at appropriate points in the liquefaction system are set forth for the previously described liquefaction of lean natural gas, at a pressure of about 865 psia and a temperature of about 30° F. are set forth in Table I below.

In Table I, the temperatures and pressures are listed for fluids passing through or contained in a flow line or piece of equipment, respectively. The numbers in the table correspond to the number of the flow line or piece of equipment as it appears in the drawing. Where negative temperatures exist, these are shown in parenthesis.

Table I

| Flow Line or Item Number | Temperature, °F. | Pressure, PSIA |
|---|---|---|
| 10 | 30 | 865 |
| 11 (Propane) | (5) | 34.7 |
| 12 (Propane) | (32) | 19.4 |
| 13 (Ethylene) | (71) | 120.1 |
| 14 (Ethylene) | (110) | 51.5 |
| 15 (Ethylene) | (138) | 24.5 |
| 21 | (1) | 865 |
| 28 | (67) | 865 |
| 31 | (106) | 865 |
| 33 | — | 600 |
| 35 | (134) | 600 |
| 37 | (141) | 600 |
| 40 | (144) | 600 |
| 44 | (159) | 335 |
| 47 | (167) | 332 |
| 53 | (185) | 179 |
| 50 | (160) | 335 |
| 52 | (185) | 179 |
| 65 | (246) | 25.5 |
| 68 | (258) | 15.0 |
| 83 | 30 | 179 |
| 79 | 30 | 59 |
| 76 | 30 | 25.5 |
| 88 | 34 | 600 |
| 89 | (106) | 600 |

As previously indicated, by reducing the pressure of a feed gas through expansion valve 32 just prior to combining the recycle vapors, but before it has been cooled to its liquefaction temperature, and by recycling flashed methane vapors from the expansion cycle and preferably also from the storage unit, to the feed gas after the feed gas has been reduced in pressure, substantial savings in the power required to compress the recycled gases are realized. Table II below compares the power requirements of the present invention (A) with the same system treating the same gas but, in one case (B) operating the liquefaction system without reducing the pressure, namely, operating condenser 15 at about 850 psia and in the other case (C) reducing the feed gas pressure to the optimum pressure of about 600 psia, prior to passage through the liquefaction system, namely; at the feed line 10.

Table II

| | A Hp Required Invention | B Hp Required No Pressure Reduction & Compressing Recycle Gas to 850 psia | C Hp Required Reducing Feed Gas Pressure to 620 psia at Line 10 |
|---|---|---|---|
| Methane Recycle Compression | 36,118 | 43,521 | 36,118 |
| Ethylene Compression | 30,728 | 31,589 | 35,558 |
| Propane Compression | 26,073 | 26,631 | 26,359 |
| Total Hp | 92,919 | 101,741 | 98,035 |
| Hp/MM $ft^3$ of LNG | 371,676 | 406.964 | 392.14 |

The savings of power attained by operating in accordance with the present invention are obviously quite significant as indicated by Table II above.

While specific equipment, materials, operating conditions and modes of operation have been described in connection with the description of the drawing and are set forth in the specific example, it is to be understood that such equipment, materials, operating conditions and modes of operation are by way of illustration only and are not to be considered limiting.

What is claimed is:

1. A process for liquefying a gas having an elevated pressure above about 650 psia, comprising:

a. cooling said gas at said elevated pressure in at least one cooling stage, by indirect heat exchange with at least one refrigerant, to a first reduced temperature close to but above its liquefaction temperature at said elevated pressure;

b. reducing the pressure of said cooled gas to a first reduced pressure substantially above atmospheric pressure and above its liquefaction pressure at said first reduced temperature;

c. further cooling said reduced pressure gas in at least one additional cooling stage, by indirect heat exchange with a refrigerant, to a second reduced temperature at which said gas is liquefied at said first reduced pressure; and d. further reducing the pressure of said liquefied gas, in at least one pressure reduction stage, to a second reduced pressure essentially equal to atmospheric pressure.

2. A process in accordance with claim 1 wherein the gas is a lean natural gas.

3. A process in accordance with claim 2 wherein the gas is substantially free of non-hydrocarbon impurities and moisture.

4. A process in accordance with claim 1 wherein the pressure is further reduced to the second reduced pressure in a plurality of stages.

5. A process in accordance with claim 4 wherein residual nitrogen is removed as a vapor phase from the liquefied gas in the first of the plural pressure reduction stages.

6. A process in accordance with claim 4 wherein the pressure is reduced in a plurality of stages by expanding the liquefied gas to successively lower pressures.

7. A process in accordance with claim 5 wherein a nitrogen containing gaseous fraction recovered as a vapor phase during the nitrogen removal step is adapted to be utilized as a fuel for the liquefaction process.

8. A process in accordance with claim 1 wherein a methane vapor phase, vaporized from the liquefied gas during the pressure reduction step in which the pressure is reduced to the second reduced pressure, is separated from the expanded liquefied gas and said methane vapor phase is combined with the feed gas after the pressure reduction step in which the gas is reduced to the first reduced pressure.

9. A process in accordance with claim 8 wherein the separated methane vapor phase is compressed to essentially the pressure of the feed gas with which it is combined prior to the combination of said methane vapor phase with said feed gas.

10. A process in accordance with claim 9 wherein the compressed separated methane vapor phase is cooled prior to combining the same with the feed gas.

11. A process in accordance with claim 8 wherein the liquefied gas is additionally cooled by countercurrent indirect heat exchange with the separated methane vapor phase of the second pressure reduction step.

12. A process in accordance with claim 1 wherein the additional cooling stage which cools the gas to the second reduced temperature and the cooling stage which cools the gas to the first reduced temperature form a last cooling stage and a next to the last cooling stage, respectively, of a plural stage cooling cycle in which a single refrigerant is supplied from an external source at successively lower temperatures from the first to the last of said plural stages.

13. A process in accordance with claim 12 wherein the next to the last of the plural cooling stages of the cooling cycle immediately precedes the reduction of the pressure of the gas to the first reduced pressure.

14. A process in accordance with claim 12 wherein the cooling cycle includes three cooling stages and the pressure of the gas is reduced to the first reduced pressure between the last and the next to the last of said plural cooling stages.

15. A process in accordance with claim 12, 13 or 14 wherein the refrigerant is supplied to the plural stages of the cooling cycle at successively lower temperatures by expanding said refrigerant to successively lower pressures.

16. A process in accordance with claim 14 wherein the gas is precooled in a second cooling cycle having at least one cooling stage, by indirect heat exchange with a second refrigerant supplied from an external source, prior to cooling said gas in the first-mentioned cooling stage.

17. A process in accordance with claim 16 wherein the second cooling cycle includes two cooling stages and the second refrigerant is supplied thereto at successively lower temperatures from the first to the last of said two cooling stages.

18. A process in accordance with claim 17 wherein the second refrigerant has a higher boiling point than the first refrigerant.

19. A process in accordance with claim 37 wherein the second refrigerant is propane and the first refrigerant is ethylene.

20. A process in accordance with claim 16, 17, 18 or 19 wherein each of the first and second refrigerants are supplied to the plural stages of their respective cooling cycles at successively lower temperatures by expanding each refrigerant to successively lower pressures.

21. A process in accordance with claim 1, 12, 13, 14, 16, 17, 18, 19, 2, 3, 4, 6, 5, 7, 8, 9, 10 or 11 in which the first reduced pressure is about 600 psia.

* * * * *